United States Patent [19]

Edwards

[11] Patent Number: 4,527,168

[45] Date of Patent: Jul. 2, 1985

[54] MOISTURE SEAL IN POWER OPERATED VEHICLE ANTENNA

[75] Inventor: Ralph W. Edwards, Rochester, Mich.

[73] Assignee: General Motors Corporation, Detroit, Mich.

[21] Appl. No.: 521,137

[22] Filed: Aug. 8, 1983

[51] Int. Cl.[3] ..... H01Q 1/10

[52] U.S. Cl. ..... 343/901; 343/903

[58] Field of Search ..... 343/715, 901, 903

[56] References Cited

U.S. PATENT DOCUMENTS

| | | | |
|---|---|---|---|
| 2,850,305 | 9/1958 | Chadowski et al. | 343/901 |
| 3,042,416 | 7/1962 | Paluszkiewicz et al. | 277/30 |
| 3,047,300 | 7/1962 | Taylor et al. | 277/102 |
| 3,047,301 | 7/1962 | Taylor et al. | 277/117 |
| 3,419,876 | 12/1968 | Edwards et al. | 343/901 |
| 4,062,156 | 12/1977 | Roth | 343/903 |
| 4,353,075 | 10/1982 | Edwards | 343/903 |

*Primary Examiner*—Eli Lieberman
*Attorney, Agent, or Firm*—Saul Schwartz

[57] ABSTRACT

A seal for preventing intrusion of moisture between a lowermost or first movable tube section of a power operated antenna mast and an insulator between the first tube section and the panel through which the mast projects, the seal including a substantially inelastic polymeric insulator mounted on the panel with a bore therethrough surrounding the first tube section, an inside surface on the insulator perpendicular to the bore intersecting the latter at a lip extending through 360° around the first tube section, and a substantially inelastic polymeric sleeve on and movable with the first tube section having an annular frustoconical seal shoulder engageable on the lip in an extended position of the first tube section to define a moisture seal between the latter and the insulator.

3 Claims, 5 Drawing Figures

MOISTURE SEAL IN POWER OPERATED VEHICLE ANTENNA

BACKGROUND OF THE INVENTION

1. Field of the Invention

This invention relates generally to vehicle body mounted power operated antennas and, more particularly, to a new and improved seal for preventing moisture intrusion into the vehicle body at full antenna mast extension.

2. Description of the Prior Art

In a typical power operated antenna installation on a vehicle body, a stationary tube is supported under a panel of the body in alignment with an aperture in the panel. A plurality of telescopically related tubes which form the antenna mast are housed in the stationary tube and are projected to extended positions by an electric motor driven linear actuator. When the mast is fully extended the lowest of the telescopic tubes projects out of the open end of the stationary tube and through an insulator disposed around the panel aperture between the lowest tube and the body panel. The necessary clearance between the insulator and the movable tube represents a potential source of moisture intrusion into the vehicle body below the apertured panel. In one known antenna installation, a rubber or similarly elastic grommet is supported on the insulator with a flange surrounding and sealing against the lowest movable mast section. The grommet flange enters a groove in the mast section to effect the seal. In another known proposal, the clearances between relatively movable mast sections are sealed by rubber or similarly elastic packings attached to one of the sections and slidably engaging the other. In still another proposal, the lowest movable tube section carries a sleeve which supports a rubber or similarly elastic O-ring having an outside diameter smaller than the inside diameter of the stationary tube so as not to interfere with relative sliding movement between the tubes. When the lowest movable tube approaches full extension, the O-ring is compressed against an inturned flange at the end of the stationary tube and a seal is formed around the movable tube. Each of these proposals requires a relatively elastic seal of rubber or like material which is subject to deterioration with age. A moisture seal arrangement according to this invention represents an improvement over these and other known proposals in that acceptable sealing is achieved in a simple and economical structure which does not require an elastic rubber-like material and is, therefore, less susceptible to deterioration with age.

SUMMARY OF THE INVENTION

Accordingly, the primary feature of this invention is that it provides a new and improved moisture seal particularly for a power operated antenna on a vehicle body. Another feature of this invention resides in the provision in the new and improved seal of an insulator on a body panel around the movable antenna sections and a sleeve on the lowest movable antenna section, one of the sleeve and insulator having an annular frustoconical sealing shoulder at full antenna extension to effect a 360° seal around the antenna. Still another feature of this invention resides in the provision in the new and improved seal of an insulator having a plurality of integral, resilient legs which snap into a support on the body panel for easy installation and, further, a bore through which the movable antenna sections project, the lower edge of the bore defining the lip which engages the frustoconical shoulder on the sleeve on the lowest movable antenna section to effect a seal around the antenna.

These and other features of this invention will be readily apparent from the following specification and from the drawings wherein.

Figures 1, 2, 3, 4, 5:
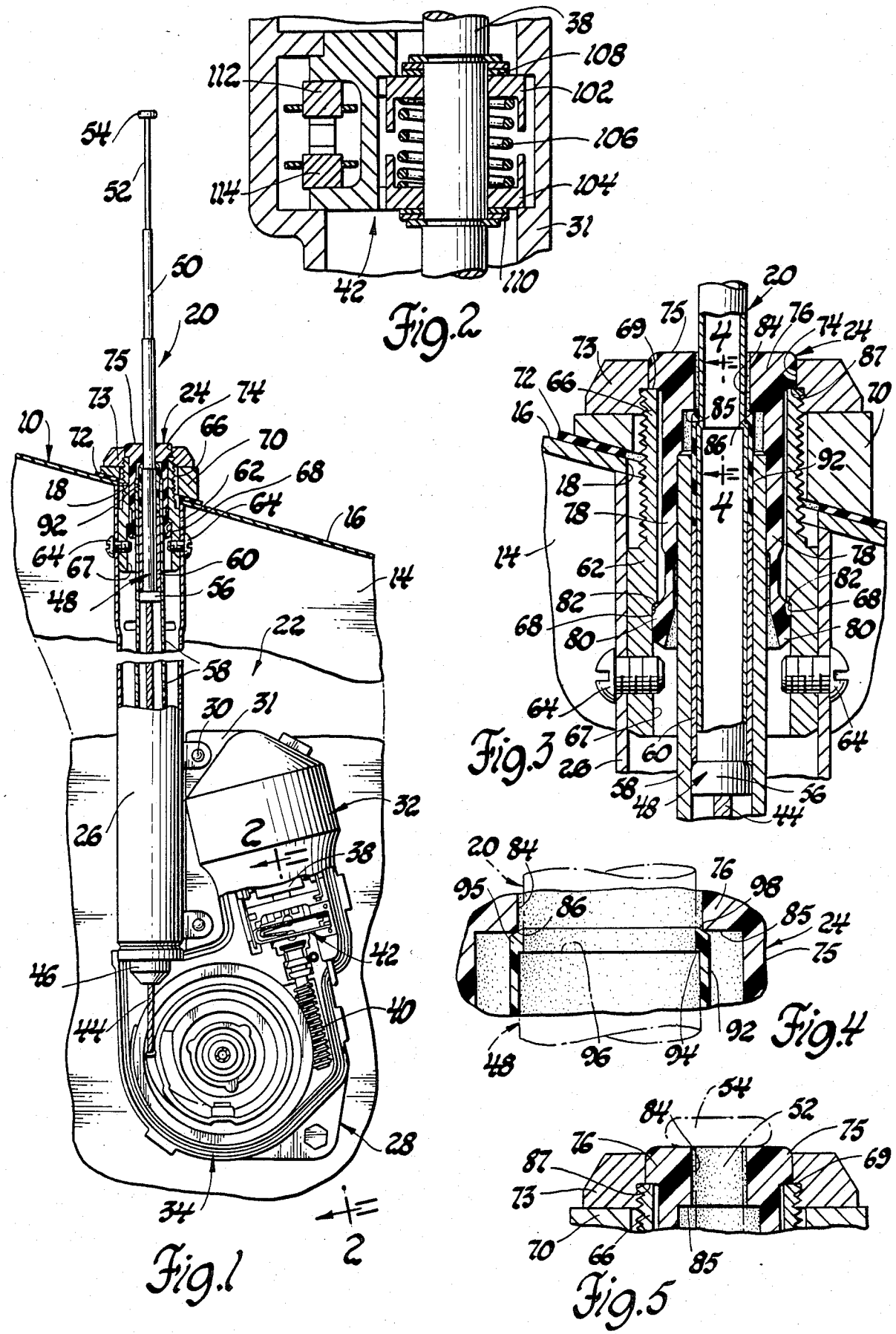
FIG. 1 is an elevational view, partly in section, of a vehicle body mounted power antenna having a moisture seal according to this invention.
FIG. 2 is an enlarged sectional view taken generally along the plane indicated by lines 2—2 in FIG. 1.
FIG. 3 is an enlarged view of a portion of FIG. 1 showing particularly the moisture seal according to this invention.
FIG. 4 is an enlarged sectional view taken generally along the plane indicated by lines 4—4 in FIG. 3.
FIG. 5 is a view of a portion of FIG. 3 showing the moisture seal achieved at full retraction of the antenna.

Referring now to FIGS. 1 and 3 of the drawings, an automobile vehicle body 10 has a representative side panel 14 and a representative upper panel 16 which may, for example, be the side and top of a rear fender defining a portion of a trunk compartment of the vehicle body. The upper panel 16 includes an aperture 18 through which a telescopically extendible and retractible mast 20 of a power operated antenna system 22 projects. The antenna system 22 includes a moisture seal 24 according to this invention for inhibiting intrusion of moisture through the aperture 18 to the interior of the compartment defined in part by the panels 14 and 16.

With reference to FIGS. 1 and 2, the antenna system 22 includes a tubular mast jacket 26 and a reversible electric motor actuator assembly 28 attached to the mast jacket at a pair of vertically spaced connections 30. The actuator assembly 28 includes a housing 31 which supports a motor 32 and a drum and storage member 34. The motor 32 includes conventional electric motor armature 38 rotatably supported on the housing 31 with an integral worm shaft 40 projecting generally tangent to the drum and storage member 34 for engagement with corresponding gear teeth on a rotatable element, not shown, in the drum and storage member. The armature 38 is rotatable in opposite directions to reversibly drive the rotatable element of the drum and storage member 34, the direction of rotation of the armature being controlled in part by a switch 42 mounted on the housing 31 in surrounding relation to the armature. For a full and complete description of the switch 42, as well as the electric motor 32, reference may be made to U.S. Pat. No. 4,153,825, issued May 8, 1979 to R. A. Flora and assigned to the assignee of this invention.

The rotatable element of the drum and storage member 34 operates to extend and retract a linear actuator 44 normally coiled within the drum and storage member. The linear actuator 44 projects through a grommet 46 at the lower end of the mast jacket 26. The drum and storage member 34 is fully described in U.S. Pat. No. 4,181,268, issued Jan. 1, 1980 to Carolus et al and assigned to the assignee of this invention. In conventional fashion, when the armature rotates, the linear actuator 44 is fed from or drawn into the drum and storage member 34 depending upon the direction of rotation of the armature.

As seen best in FIG. 1, the mast 20 has a lowermost or first movable tube section 48, a second movable tube section 50 telescopically disposed in the first tube section 48, and a movable rod 52 having a cap or finial 54 thereon telescopically disposed in the second tube section 50. In addition to being telescopically related, each of the tube sections and the rod are in electrically conductive relationship for reception of audio signals. The distal end of the linear actuator 44, not shown, projects through the first and second tube sections 48 and 50 and is attached to the lower end of the rod 52 so that as the linear actuator is fed from the drum and storage member 44 the rod 52 is lifted to extend the mast 20 and as the linear actuator 44 is retracted into the drum and storage member the rod 52 is pulled downwardly to retract the mast. The first tube section 48 has an enlarged lower end 56 which forms a sliding bearing on an electrically conductive stationary tube 58 rigidly supported in but electrically insulated from the mast jacket 26. A conventional radio antenna connection, not shown, between the stationary tube 58 and the receiver in the vehicle carries the audio signals received by the mast 20 to the receiver. To complete the antenna circuit between the receiver and the mast 20, a metal sleeve 60 is disposed around the first tube section 48 adjacent the enlarged end 56 with a plurality of integral spring fingers, not shown, biased outward against the inside diameter of the stationary tube 58.

As seen best in FIGS. 1 and 3, the upper or distal end of the mast jacket 26 is aligned with the aperture 18 in the upper panel 16. A mounting sleeve 62 is disposed within and rigidly attached to the mast jacket 26 by a pair of screws 64. The sleeve 62 has a threaded end 66 projecting out through aperture 18, a stepped bore 67 with a shoulder 68 therein, and an annular end face 69. An escutcheon 70 outboard of the upper panel 16 is disposed around the threaded end 66 of the mounting sleeve over a gasket 72 between the escutcheon and the panel 16. A decorative nut 73 having a bore 74 therethrough captures the escutcheon and the gasket 72 to provide a moisture seal between the threaded end 66 of sleeve 62 and the panel 16. The moisture seal 24 according to this invention is disposed between the first tube section 48 of the mast 20 and the unit formed by the mounting sleeve, the escutcheon and the nut 73.

Referring particularly now to FIGS. 3 and 4, the moisture seal 24 includes a substantially inelastic polymeric insulator 75 having a head portion 76 in the bore 74 and a plurality of integral legs 78 arranged cylindrically around the insulator. Each of the legs 78 has an enlarged end 80 defining a hook 82 engaging the shoulder 68 of the stepped bore 67 through the sleeve 62. A bore 84 extends through the head portion 76 and intersects an inside surface 85 of the head portion perpendicular to the bore 84 at a circular lip 86. An annular shoulder 87 defined on the head portion around the integral legs 78 seats on the annular end face 69 of the sleeve. The length of the insulator between the hooks 82 and the annular shoulder 87 corresponds to the distance between the shoulder 68 in the stepped bore 67 and the annular end face 69 of the sleeve 62 so that the hooks tightly hold the insulator on the sleeve. In addition, the head portion is closely received in the bore 74 in the decorative nut 73 so that an external moisture tight seal is defined between the insulator 75 and the upper panel 16.

The moisture seal 24 further includes a substantially inelastic polymeric sleeve 92 tightly received on the first tube section 48 of the mast 20 above the metal sleeve 60. At the upper end of the sleeve 92 an internal annular shoulder 94 is defined below an inwardly directed annular flange 95 of the sleeve. When the sleeve is disposed over the first tube section 48, the shoulder 94 seats on a corresponding shoulder 96 of the first tube section, FIG. 4, so that downwardly directed forces on the sleeve do not push it and the metal sleeve 60 further down on the first tube section. An annular seal shoulder 98 at the top of flange 95 of the sleeve 92 forms an annular frustoconical surface around and movable as a unit with the first tube section 48. The lip 86 at the intersection of the bore 84 and the inside surface 85 of the insulator 75, FIGS. 4 and 5, engages the seal shoulder 98 when the first tube section 48 achieves an extended position, FIGS. 1, 3 and 4, corresponding to full extension of the mast 20.

The switch 42, being responsive to stalling of the linear actuator 44 as described in the aforementioned U.S. Pat. No. 4,153,825 to R. A. Flora, cooperates with the polymeric insulator 75 and the polymeric sleeve 92 in effecting moisture tight seals at full extension and full retraction of the mast 20. More particularly and with reference to FIGS. 1 and 2, the armature 38 is supported on the housing 31 for limited fore and aft bodily shiftable movement. A pair of switch actuators 102 and 104 are slidably disposed around the armature with a spring 106 captured between the actuators and thrusting them axially in opposite directions against a pair of stops 108 and 110, respectively, on the armature. The switch actuators are adapted to engage respective ones of a pair of switch contacts 112 and 114 such that when the armature shifts downwardly, FIG. 2, the switch actuator 102 engages the contact 112 to move the latter downwardly and interrupt a circuit defined across the contact. Similarly, when the armature 38 moves upwardly, FIG. 2, the switch actuator 104 engages the switch contact 114 to interrupt a circuit defined across the contact 114. In the neutral or non-shifted position of the armature 38, shown in FIG. 2, both of the switch contacts 112 and 114 are in closed positions completing the circuits thereacross.

Describing now the operation of the antenna system 22 and commencing with the mast 20 fully retracted, FIG. 5, and cap 54 abutting the insulator 75, energization of the motor 32 initiates proper rotation of the worm shaft 40 and consequent projection of the linear actuator 44 out of the drum and storage member 34. The linear actuator, being operative in tension and compression, pushes the rod 52 upwardly causing sequential telescopic extension of the rod, the second tube section 50 and then the first tube section 48. The first tube section rises toward the fully extended position, FIG. 1, until the seal shoulder 98 on the polymeric sleeve 92 engages the lip 86 defined around the bore 84 in the insulator head portion. The lip and seal shoulder cooperate in obstructing further upward movement of the first tube section thereby stalling the linear actuator 44. The armature 38, however, continues turning in the direction corresponding to mast extension causing the worm shaft 40 to apply a preload to the linear actuator tightly forcing the seal shoulder against the lip.

The magnitude of the preload is proportional to the force exerted by spring 106 in the switch 42. That is, as the armature continues to rotate the worm shaft 40 threads itself against the formerly rotating but now stationary element of the drum and storage member 34 causing the armature to shift axially in a direction corresponding to the rotation of the armature. Assuming, for discussion, the rotation of the armature after the linear actuator is stalled causes the armature to shift downward, FIG. 2, the switch actuator 102 engages the switch contact 112 causing the latter to move downward and interrupt the circuit thereacross energizing the motor in the mast extending direction. Because of the relative leads between the worm formed on the worm shaft 40 and the gear teeth formed on the rotating element of the drum and storage member 34, preload is maintained on the linear actuator after the motor is deenergized with no tendency of the preload to effect backdrive of the armature for relief of the preload. Accordingly, with the mast 20 fully extended, the seal shoulder 98 is maintained tightly against the lip 86 thereby effecting a moisture tight seal between the first tube section 48 and the insulator 75 and, hence, between the first tube section and the upper panel 16 of the vehicle body.

To retract the mast 20, the motor 32 is energized in the opposite direction causing the worm shaft 40 to rotate the rotating element of the drum and storage member 34 in a direction retracting the linear actuator 44. Accordingly, the linear actuator pulls the rod 52 downward until cap 54 engages the upper end of second tube section 50 whereupon the rod and second tube section descend until the cap 54 engages the upper end of first tube section 48 whereupon all three continue downward toward full mast retraction where the cap 54 engages the top of the insulator 75, FIG. 5. With the cap 54 against the insulator, the linear actuator 44 is stalled in the opposite direction. The armature 38, however, continues to rotate so that once again the worm shaft 40 threads itself on the rotating element of the drum and storage member causing the armature to shift in the opposite direction, upwardly in FIG. 2. The switch actuator 104 then engages and lifts switch contact 114 to interrupt the circuit energizing the motor in the mast retracting direction. Again, because of the relative leads between the worm on the worm shaft 40 and the gear teeth on the rotating element of the drum and storage member, the preload on cap 54 urging the latter downwardly against the top of the insulator maintains a moisture tight seal between the rod 52 and the insulator 75.

The embodiments of the invention in which an exclusive property or privilege is claimed are defined as follows:

1. In a power operated antenna installation on a panel of a vehicle body including a stationary tube mounted on said body in alignment with an aperture in said panel, a first tube section disposed in said stationary tube for telescopic movement in extension and retraction relative thereto, and reversible electric motor operated linear actuator means between said body and said first tube section operative in one mode to drive said first tube section in either one of said extension and said retraction and in another mode to maintain said first tube section in one of an extended positions and a retracted position under a preload against an obstruction to continued movement, the combination comprising, a substantially inelastic polymeric insulator disposed in said aperture including a bore for passage of said first tube section, means defining a moisture tight seal between said insulator and said panel, a substantially inelastic polymeric sleeve on said first tube section movable as a unit therewith, means on one of said insulator and said sleeve defining an annular frustoconical seal shoulder, and means on the other of said insulator and said sleeve defining a circular lip engageable on said seal shoulder in line contact through 360° around said first tube section in said extended position of the latter, said lip and said seal shoulder cooperating to define an obstruction to continued movement of said first tube section beyond said extended position so that said lip and said seal shoulder are maintained in preloaded sealing engagement by said actuator means in said extended position of said first tube section.

2. In a power operated antenna installation on a panel of a vehicle body including a stationary tube mounted on said body in alignment with an aperture in said panel, a first tube section disposed in said stationary tube for telescopic movement in extension and retraction relative thereto, and reversible electric motor operated linear actuator means between said body and said first tube section operative in one mode to drive said first tube section in either one of said extension and said retraction and in another mode to maintain said first tube section in one of an extended position and a retracted position under a preload against an obstruction to continued movement, the combination comprising, a substantially inelastic polymeric insulator disposed in said aperture including a bore for passage of said first tube section, means defining a moisture tight seal between said insulator and said panel, a substantially inelastic polymeric sleeve disposed on said first tube section for unitary movement therewith relative to said stationary tube, means on said sleeve defining an annular frustoconical seal shoulder around said first tube sections, and means on said insulator defining a circular lip at the intersection of said bore and an inside surface of said insulator engageable on said seal shoulder in line contact through 360° around said first tube section in said extended position of the latter, said lip and said seal shoulder cooperating to define an obstruction to continued movement of said first tube section beyond said extended position so that said lip and said seal shoulder are maintained in preloaded sealing engagement by said actuator means in said extended position of said first tube section.

3. In a power operated antenna installation on a panel of a vehicle body including a stationary tube mounted on said body in alignment with an aperture in said panel, a first tube section disposed in said stationary tube for telescopic extension and retraction relative thereto, and reversible electric motor operated linear actuator means between said body and said first tube section operative in one mode to drive said first tube section in either one of said extension and said retraction and in another mode to maintain said first tube section in one of an extended position and a retracted position under a preload against an obstruction to continued movement, the combination comprising, a mounting sleeve rigidly attached to said panel with a threaded portion projecting through said aperture and with a stepped bore thereof aligned with said stationary tube, said mounting sleeve defining an internal annular shoulder between portions of said stepped bore, escutcheon means on said panel defining a moisture tight seal between said mounting sleeve and said panel, a substantially inelastic polymeric insulator disposed in said stepped bore with a head portion thereof seated on an end of said mounting sleeve and with a plurality of integral resilient legs thereof engaging said internal annular shoulder in hook-like fashion to retain said insulator on said mounting sleeve, means on said insulator defining a bore through said head portion for passage of said first tube section therethrough, means on said insulator defining an inside surface perpendicular to said bore, said bore intersecting said inside surface to define a lip around said first tube section, and a substantially inelastic polymeric sleeve rigidly supported on said first tube section for unitary movement therewith relative to said stationary tube having a beveled edge defining an annular frustoconical seal shoulder engageable on said lip in line contact through 360° around said first tube section in said extended position of the latter, said lip and said seal shoulder cooperating to define an obstruction to continued movement of said first tube section beyond said extended position so that said lip and said seal shoulder are maintained in preloaded sealing engagement by said actuator means in said extended position of said first tube section.

* * * * *